US009539846B2

(12) United States Patent
Barausky

(10) Patent No.: US 9,539,846 B2
(45) Date of Patent: Jan. 10, 2017

(54) BINDING MACHINE

(71) Applicant: Staples The Office Superstore, Inc., Framingham, MA (US)

(72) Inventor: Sasha Barausky, Sherborn, MA (US)

(73) Assignee: Staples The Office Superstore, Inc., Framingham, MA (US)

( * ) Notice: Subject to any disclaimer, the term of this patent is extended or adjusted under 35 U.S.C. 154(b) by 661 days.

(21) Appl. No.: 13/788,693

(22) Filed: Mar. 7, 2013

(65) Prior Publication Data

US 2014/0255126 A1 Sep. 11, 2014

(51) Int. Cl.

| | |
|---|---|
| ***B26F 1/00*** | (2006.01) |
| ***B26F 1/02*** | (2006.01) |
| ***B42B 5/08*** | (2006.01) |
| ***B42C 5/04*** | (2006.01) |
| ***B26F 1/12*** | (2006.01) |
| *B26D 7/00* | (2006.01) |

(52) U.S. Cl.

CPC . *B42B 5/08* (2013.01); *B26F 1/12* (2013.01); *B42C 5/04* (2013.01); *B26D 2007/0087* (2013.01); *B26F 2210/02* (2013.01); *Y10T 29/49826* (2015.01); *Y10T 83/885* (2015.04)

(58) Field of Classification Search

CPC ..... B42C 5/04; B42B 5/08; B26F 1/12; B26F 2210/02; B26D 2007/0087; Y10T 83/885; Y10T 29/49826

USPC ..... 83/620, 618, 633, 563, 684, 687, 669; 412/7, 38

See application file for complete search history.

(56) References Cited

U.S. PATENT DOCUMENTS

| | | | | |
|---|---|---|---|---|
| 5,549,433 | A * | 8/1996 | Byrne | 412/39 |
| 6,074,152 | A * | 6/2000 | Vecchi | 412/39 |
| 6,350,096 | B1 * | 2/2002 | Helver | 412/33 |
| D564,593 | S * | 3/2008 | Kent et al. | D19/72 |
| 7,610,838 | B2 * | 11/2009 | Kent et al. | 83/618 |
| 8,109,189 | B2 * | 2/2012 | Tsai | 83/618 |
| 9,044,988 | B2 * | 6/2015 | Barausky | |
| 2009/0223341 | A1 * | 9/2009 | Huang | 83/588 |
| 2013/0071206 | A1 * | 3/2013 | Chiang | 412/38 |

* cited by examiner

*Primary Examiner* — Omar Flores Sanchez
(74) *Attorney, Agent, or Firm* — Sheridan Ross P.C.

(57) ABSTRACT

A punching and binding machine used to bind sheets to discs. The machine may include a lever with a first arm, a second arm, and a third arm. Each arm may be pivotally and slidably connected to minimize the force required by a user to punch cutouts in a stack of sheets. The lever may include a flipper connected to a binding member to actuate punching and binding simultaneously.

17 Claims, 16 Drawing Sheets

FIGURE 18

1. Binding machine is open and ready to operate

2. Ring rack carriage is slid forward to loading position

3. Discs are loaded into ring rack

4. Ring rack carriage is slid rearwardly to binding position

5. Sheets are inserted into punching portion of binding machine

6. Lever is pressed to activate punching portion

7. Lever is released

8. Punched sheets are removed from the punching portion

9. Punched sheets are inserted into the binding portion of the binding machine

10. Lever is pressed to activate the binding member to bind the sheets to the discs 11. Lever is released 12. Steps 5-11 are repeated until presentation is complete 13. Completed presentation is removed from the binding machine

FIGURE 19

1. Metal housing is stamped and formed into punch fram (98).

2. Plastic components are injection molded.

3. Punch heads (115) are assembled onto punch frame (112).

4. Punch arms (110) are assembled onto punch fram (112).

5. Disk rack carriage (120) is assembled onto binding frame (113).

6. Disk rack (118) is assembled onto Disk rack carriage (120).

7. Binding member (140) is assembled onto Disk Rack (118)

8. Punch mechanism (111) is assembled onto binding mechanism (99).

9. Spring (162) and flipper arms (160) assembled onto punch mechanism (111)and aligned with binding member (140)

10. Outer plastic housing fitted over punch and binding mechanism

BINDING MACHINE

BACKGROUND

Binding machines may be used to form presentations. Those presentations may include binding sheets of paper to discs.

SUMMARY

One embodiment is directed to a punching and binding machine for assembling presentations comprising:

a chassis;

a punching device configured to punch at least one cutout along an edge of a sheet, wherein at least a portion of the at least one cutout has a width wider than a width of the cutout measured at the edge;

a disc rack carriage for holding at least one disc having a raised periphery, the raised periphery adapted to be received in the at least one cutout;

a binding member configured and arranged to press a portion of the sheet surrounding the at least one cutout onto the raised periphery of the at least one disc;

a lever configured to actuate the punching devices and the binding member simultaneously.

BRIEF DESCRIPTION OF DRAWINGS

FIG. 18 is a flow diagram for a method of using the binding machine according to one embodiment; and FIG. 19 is a flow diagram for a method of assembling the binding machine according to one embodiment.

DETAILED DESCRIPTION

The inventors have recognized and appreciated design techniques for a disc-binding machine that are improved, simple and easy to use. The disc-binding machine is designed to punch and bind sheets of paper onto discs to create a disc-bound notebook. Minimal input is required by the user—the user simply inserts the appropriate number of discs and continues to punch and bind the sheets of paper until the presentation is complete. The final product is professional and polished and is easily removed from the binding machine.

The disc-binding machine may be relatively compact and designed with minimal parts such that it is easy to use, lower in cost, and durable. The disc-binding machine may include only one lever to activate both punching and binding. A user may punch cutouts in one stack of paper while simultaneously binding another stack of sheets to the discs. The lever may contain features that allow a complete punch through a stack of sheets in the punching portion while compensating for a continually increasing number of sheets in the binding portion. The lever also may include features to allow a larger capacity of sheets to be punched and bound with minimal pressing force. In one embodiment, the disc-binding machine may bind up to ninety pages in sets of sixteen pages, but the invention is not so limited. Accordingly, presentation can be created more efficiently and effortlessly.

The disc-binding machine may further include features for creating professional and polished presentations. The disc-binding machine may include sheet alignment features to ensure that each stack of sheets are properly positioned when they are punched and bound. These features prevent a final product with uneven pages. Additionally, the binding portion may be designed to carefully align and press the cutout portion of the sheets onto the discs to prevent creasing or tearing of the sheets around the cutouts. The disc-binding machine may also be versatile and accommodate discs and paper of different sizes.

Figure 1:
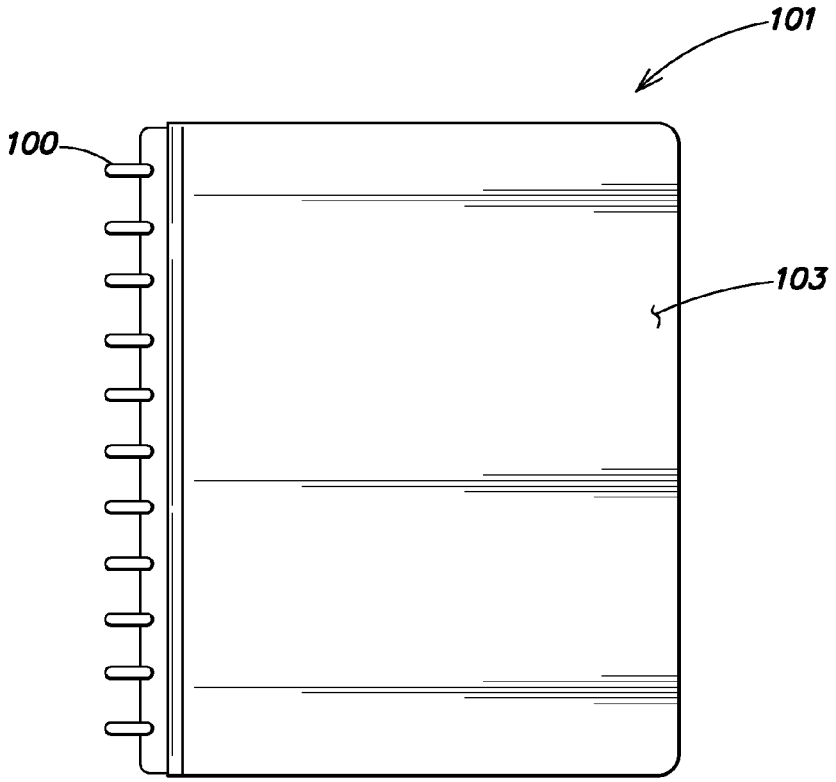
FIG. 1 is a front view of a disc-bound notebook presentation.
Figure 2:
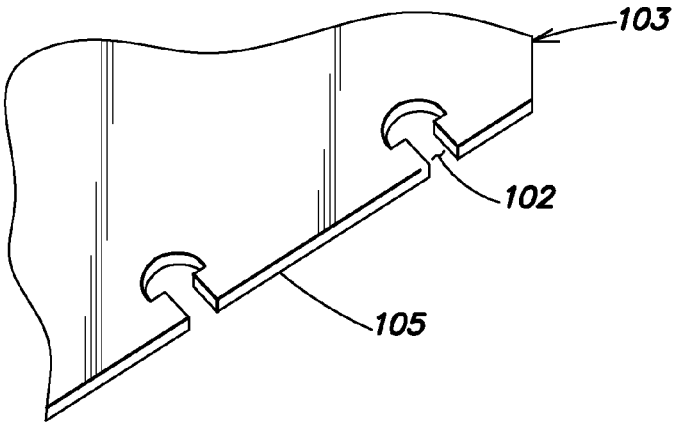
FIG. 2 is a perspective view a sheet with cutout according to one embodiment.
Figure 3:
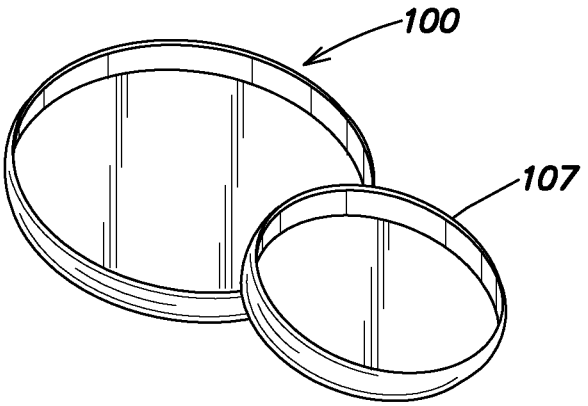
FIG. 3 is a perspective view of a disc according to one embodiment.
Figure 4:
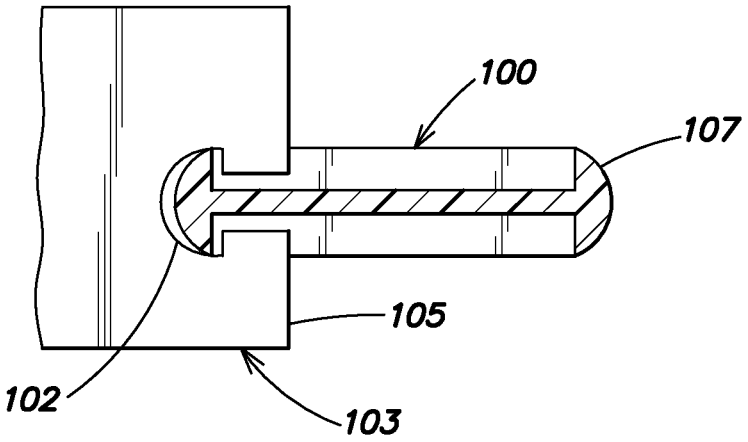
FIG. 4 is a front sectional view of a disc bound to a cutout according to one embodiment.

Turning now to the figures, FIG. 1 shows a disc-bound notebook presentation 101 with sheets 103 bound together by a set of discs 100. The sheets may include sheets of paper, front and back covers, and any other notebook type insert (e.g., folders, plastic envelopes, notebook dividers, calendars, leather or plastic covers). Throughout the disclosure, any reference to "a sheet" may include one sheet or a stack of sheets or any type of sheets or insert. As shown in FIGS. 2 through 4, each sheet includes cutouts 102 along a binding edge 105 that are designed to grip a raised periphery 107 of the discs 100. The cutouts 102 may be shaped to match the curvature of the raised periphery 107, such that the cutouts grip the raised periphery, as shown in FIG. 4. The cutouts 102 may be mushroom-shaped in cross-section, with the stem of the mushroom at the binding edge 105, or may be any other shape that allows the cutout to grip the raised periphery 107. For example, the cutout may be shaped such that a portion of the cutout has a width wider than a width of the cutout measured at the binding edge 105 (e.g., triangular-shaped, t-shaped). The discs 100 may be circular or any other shape (e.g., square, half-circular, triangular, oval) with a peripheral edge to fit into the cutout 102.

Figure 5:
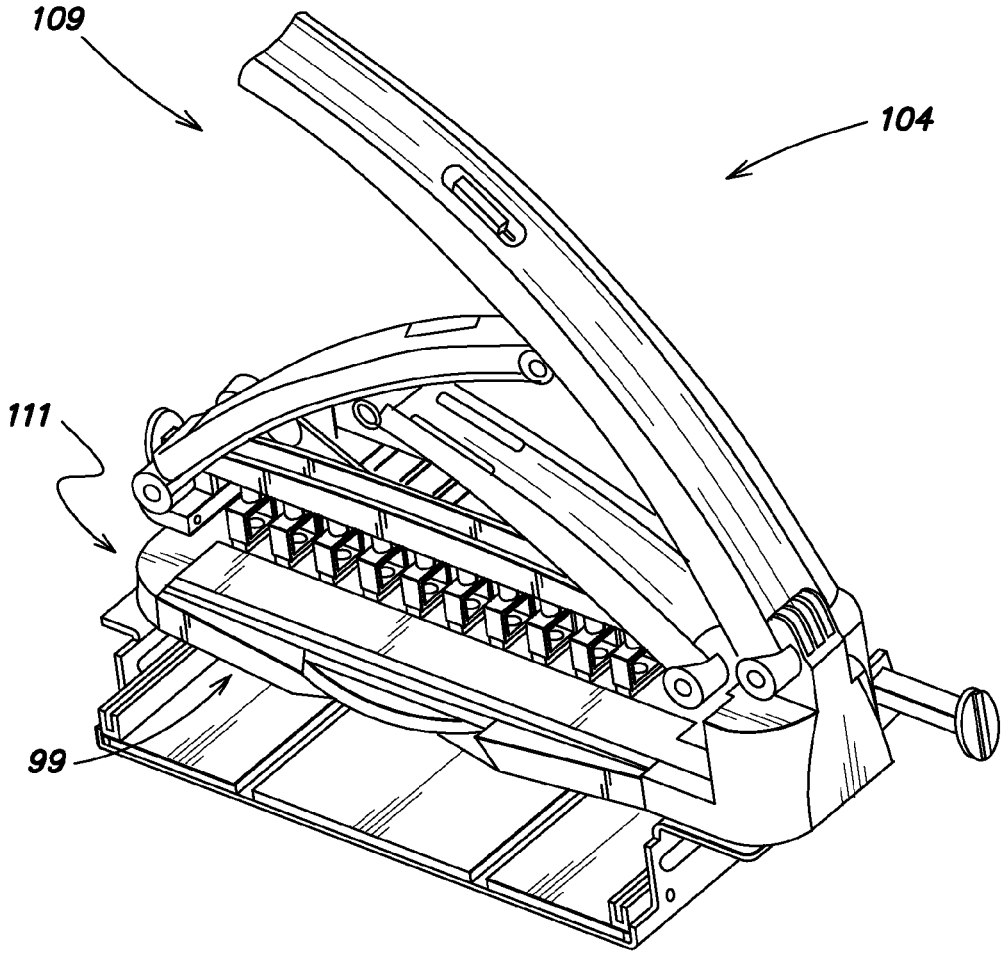
FIG. 5 is a front perspective view of a binding machine according to one embodiment.

A presentation may be assembled using a disc-binding machine 104, according to one embodiment, shown in FIG. 5. The disc-binding machine may include a punching portion 111 and a binding portion 99. A user may create a presentation by inserting a sheet into the punching portion 111 and activating a lever to punch cutouts in a binding edge thereof. The user may then remove the punched sheet, insert it into the binding portion 99, and activate a lever 109 to bind the sheet to the discs. Pre-punched sheets may also be used; in that case the user may skip the punching step and simply insert the pre-punched sheets into the binding portion. The disc-binding machine 104 may include one lever 109 to actuate punching and binding simultaneously. Alternatively, separate levers may be used for punching and binding.

Figure 6:
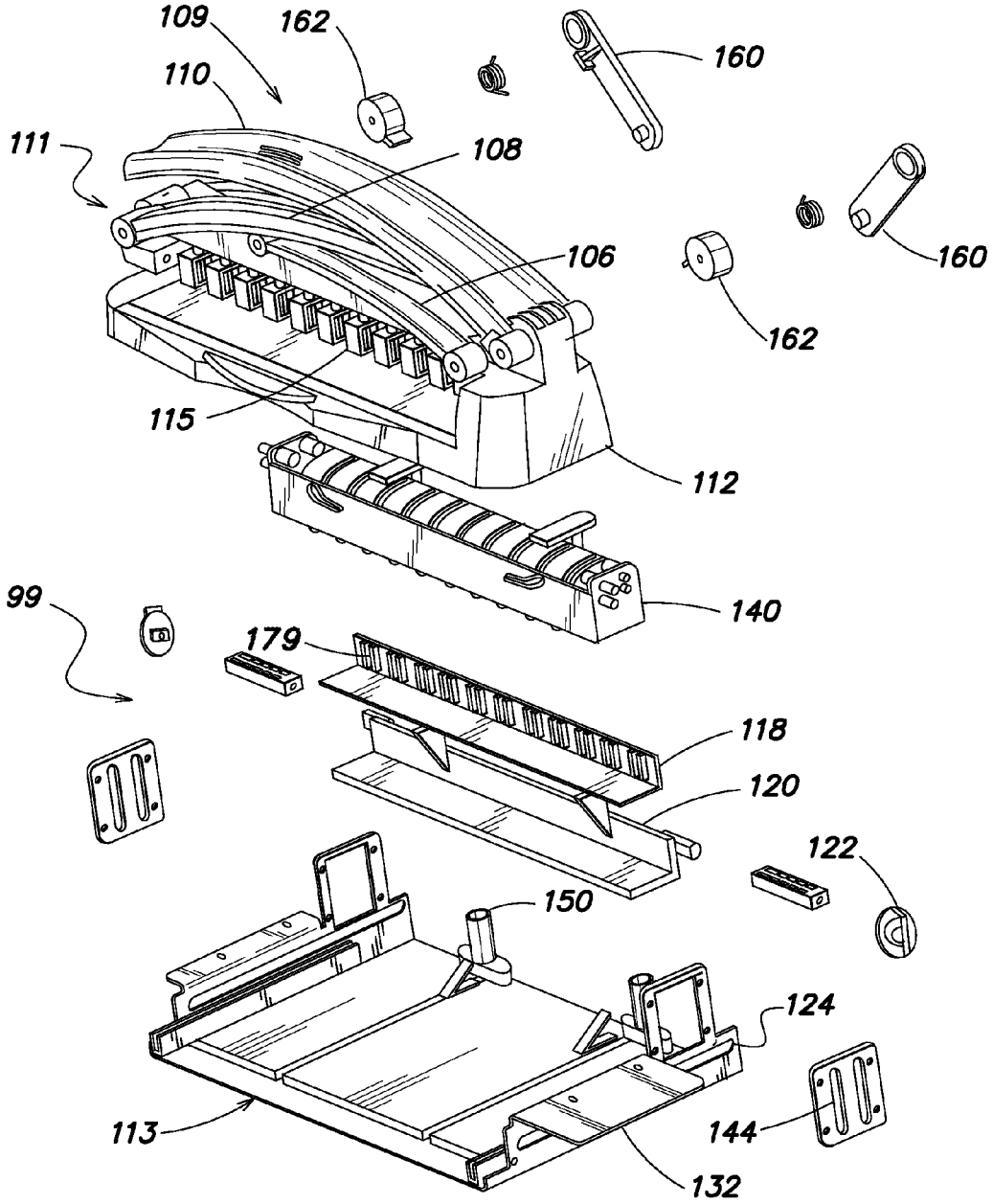
FIG. 6 is an exploded view of the binding machine of FIG. 5.

FIG. 6 illustrates the design and features of the disc-binding machine according to one embodiment. The machine may include a punching portion 109 and a binding portion 99. The punching portion may include a base 112, a plurality of punching devices 115, and a lever 109 with one or more arms. In one embodiment, the lever 109 includes three arms, specifically a second arm 106, a first arm 108, and a third arm 110. The binding portion 99 may include a binding chassis 113, a disc rack 120 for loading the discs, and a binding member 140 to press cutouts 102 of a sheet 103 onto discs 100 held in the disc rack 120. The binding fingers may be activated by the lever 109. For example, the machine may include flippers 160 and flipper connectors 162 to connect the binding fingers to the lever 109 such that activation of the lever 109 activates the plurality of punching devices 115 and the binding member 140 simultaneously.

Figure 7:
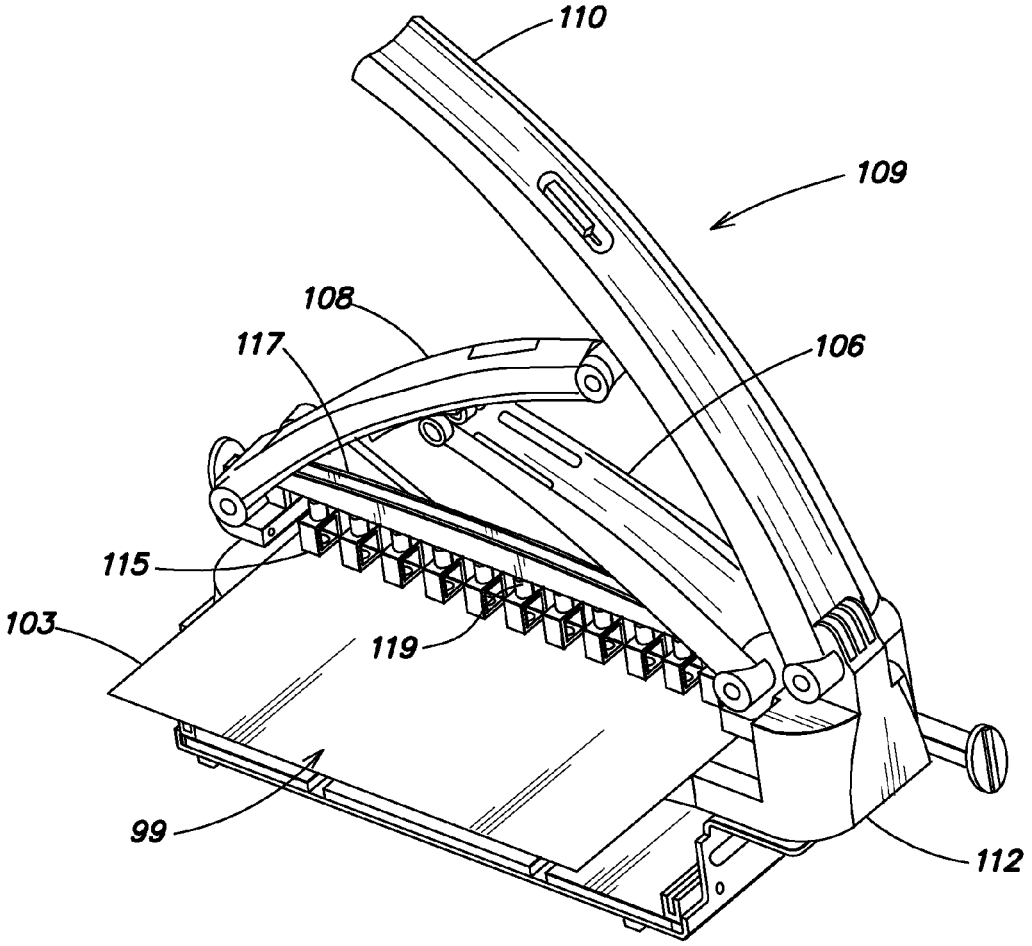
FIG. 7 is a front perspective view of the binding machine of FIG. 5 in an inactivated state.
Figure 8:
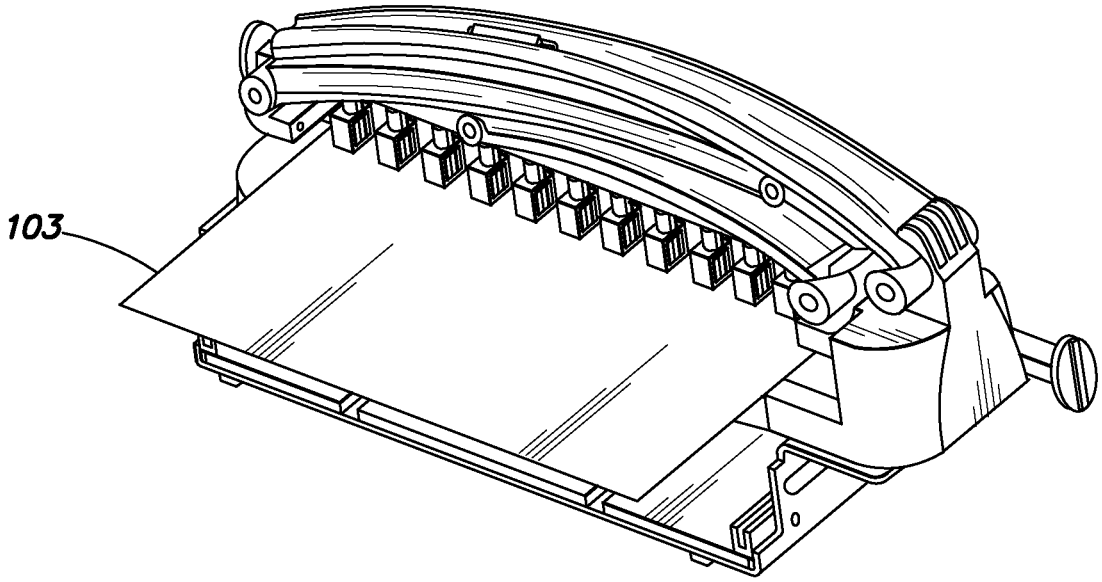
FIG. 8 is a front perspective view of the binding machine of FIG. 5 in an activated state.

FIGS. 7 and 8 illustrate the punching portion 111 in a non-activated position and an activated position, respectively. The punching portion 111 may be assembled above the binding portion 99. The punching portion 111 may include a base 112 and a lever 109 with one or more arms, for example, including a second arm 106, a first arm 108, and a third arm 110, that are pivotally and/or slidably connected to minimize the force required by the user to actuate the lever 109. In one embodiment, the lever 109 includes three arms, specifically a second arm 106, a first arm 108, and a third arm 110, that are pivotally connected to the base 112 at one end of each arm. The other ends of the second arm 106 and the first arm 108 are slidably connected to a bottom side of the first arm 108 and the third arm 110, respectively. When a user presses on the third arm 110 with a downward force, the other ends of the second arm 106 and the first arm 108 will slide toward the pivotally connected ends of the first arm 108 and the third arm 110, respectively. With a three-arm lever as described, the force required to actuate the lever to punch cutouts in multiple sheets of paper may be reduced. In one embodiment, a pressing force of only twenty pounds may punch through a stack of sixteen sheets of paper.

Figure 9:
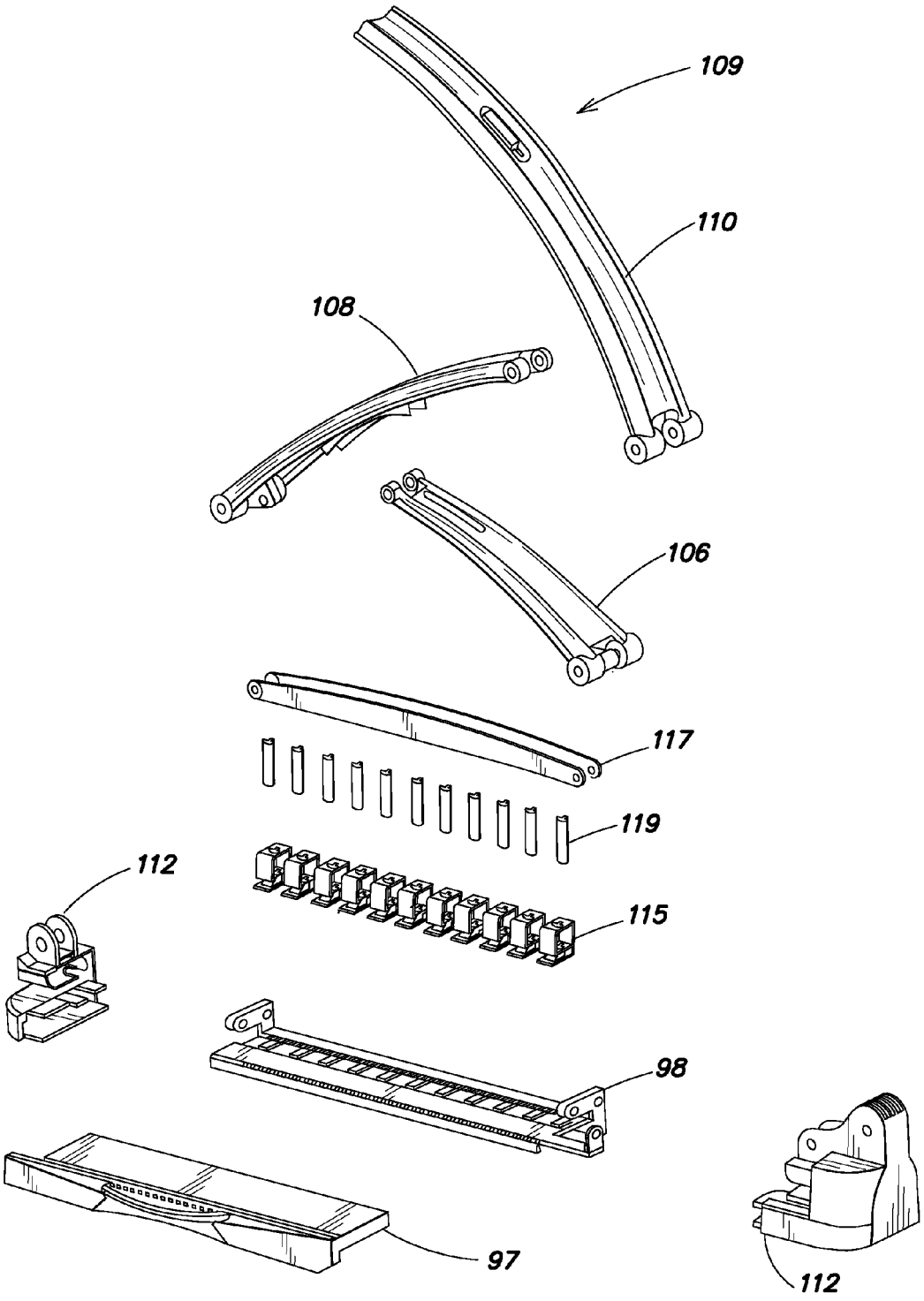
FIG. 9 is an exploded view of the punching portion according to one embodiment.

As shown in FIG. 9, the punching portion 111 may include a base 112, punching devices 115, and a lever 109. The base may include a paper alignment member 98 and a punching tray 97. Sheets may be inserted above the punching tray 97 into the alignment member 98 with the binding edge 105 aligned under the punching devices 115. The lever 109 compresses bar 117 which in turn pushes down a plurality of punches 119 in the plurality of punching devices 115 to punch cutouts 102 along the binding edge 105 of the sheets 103. The punching mechanism, in one embodiment, may be described in patent application Ser. No. 11/731,785, which is herein incorporated by reference.

Figure 10:
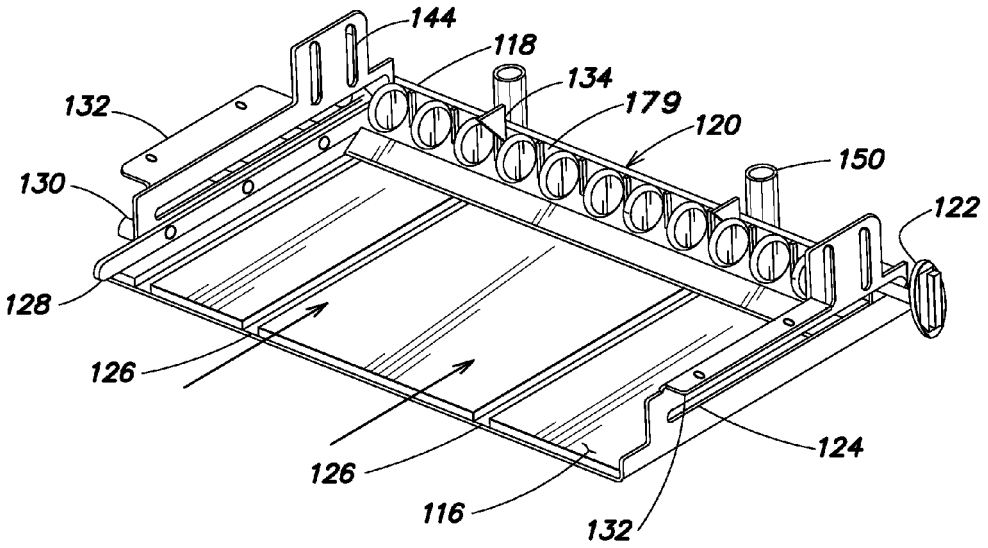
FIG. 10 is a front perspective view of a binding portion according to one embodiment.

According to one embodiment, the punching portion may be connected to the binding chassis 113 by fastening the base 112 to side panels 132. The punching portion may be permanently fastened to the chassis or may be removable. FIG. 10 illustrates the binding chassis 113 according to one embodiment. The side panels 132 may include screw holes 133 for fastening the punching portion 111. Alternatively, the punching portion may be fastened to the biding portion by any other means (e.g., adhesive, ties, nails, etc.). The binding chassis 113 may include a base 116 between the side panels 132. Sheets of paper may be inserted into the binding portion on base 116. The binding chassis 113 may further include a disc rack carriage 120 for loading the discs 100. The disc rack carriage may have one or two handles 122 that are secured to the disc rack carriage through sliding slit 124. The disc rack carriage may be slid between a front loading position and a rear binding position by moving handles 122 forwardly and rearwardly. The disc rack carriage 120 may include bottom knobs (not shown) that slide in tracks 126 of the base 116.

To load the discs, the user may pull the handles 122 to slide the disc rack carriage 120 to the forward loading position. The user then inserts the discs 100 into the disc rack 118, putting the discs into slots 179. Once the discs 100 are loaded, the user may use the handles 122 to push the disc rack carriage 120 rearwardly into the binding position. In one embodiment, the disc rack carriage 120 must be in a fully rearward position in order to activate the lever to initiate binding.

The disc rack carriage 120 may include a disc rack 118 for holding a plurality of discs 100, as best shown in FIGS. 6 and 10. The disc rack 118 may be integral with the disc rack carriage 120 or they may be separate pieces. The disc rack 118 may have slots 179 that secure discs 100 in place during the binding action. The disc rack 118 and/or slots 179 may be made of rubber or any other material that frictionally holds the discs 100. The slots 179 may accommodate discs 100 of different diameters and thicknesses. For example, the slots 179 may be appropriately sized such that differently sized discs may fit snugly into the slot, with the larger discs having a snugger fit than the smaller discs. Alternatively, separate disc racks 118 may be designed for use with different sized discs; the user may change the disc rack 118 in the disc rack carriage 120 as necessary depending on the size presentation desired. In one embodiment, the disc rack 118 may hold eleven discs, but the disc rack may also hold more or less discs depending on the size of the presentation to be assembled.

Figure 11:
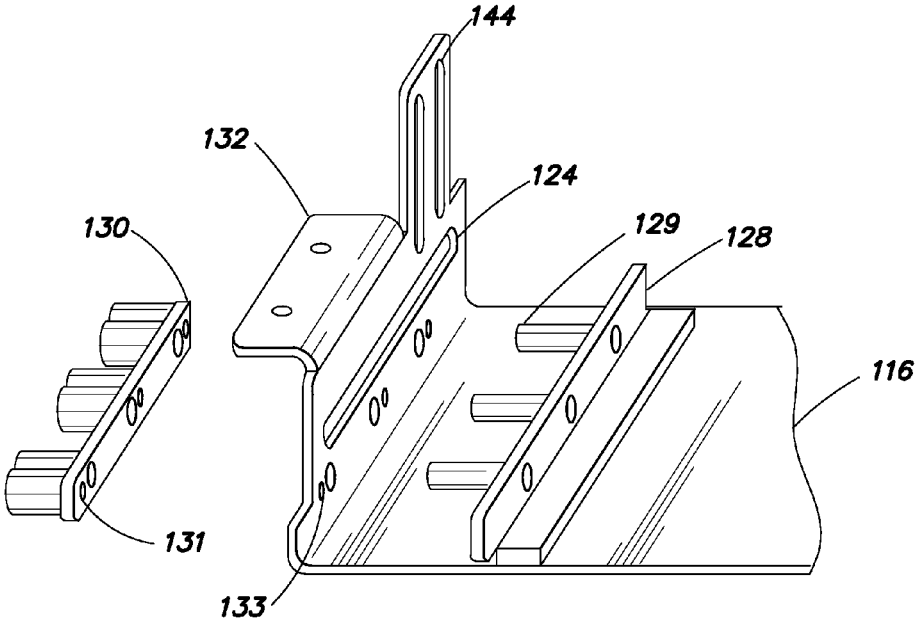
FIG. 11 is a perspective view of the binding portion of FIG. 10.

As shown in FIG. 11, the binding chassis 113 may further include features to properly align the sheets in the binding portion 99. The binding chassis may include sheet alignment members 128, 130 to accommodate sheets of different sizes to ensure that the cutouts line up with the discs. For example, a user may use letter or A4 sized paper to create a presentation. According to one embodiment, exterior sheet alignment member 130 may be fastened to side wall 132 and may include sets of channels 131 of varying different lengths (e.g., one set for letter size paper and one set for A4). Exterior sheet alignment member 130 may be integral with side wall 132 or may be formed of a separate piece. Interior sheet alignment member 128 may include protrusions 129 that fit into the sets of channels 131 through holes 133 of side wall 132. When a user wishes to use A4 sized paper, for example, the user may insert the protrusions 129 into a set of designated A4 sized channels, which may have a greater length than the letter sized channels, such that the sheet alignment member 129 may sit closer to side wall 132. The user may insert the protrusions into the appropriate set of channels depending on what sheet size is being used. One of skill in the art would appreciate other features and designs for selecting various paper size options.

Figure 12:
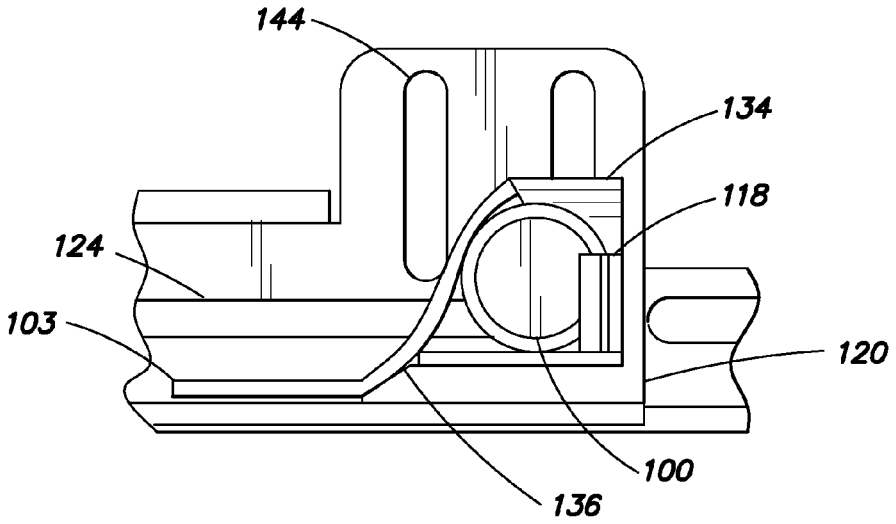
FIG. 12 is a side view of the binding portion according to one embodiment.

According to one embodiment, as shown in FIG. 12, the disc rack carriage 120 may also include an angled front portion 136 and a stop 134 to position the sheets in the binding portion. Proper alignment of the sheets may facilitate binding and prevent creasing and tearing of the sheets around the cutouts. The angled front portion 136 may lift and position the sheet 103 at an appropriate binding angle above the discs 100 as the sheet 103 is inserted into the binding portion 99. The stop 134 may alert a user that the sheet 103 has been inserted into the proper position by preventing further insertion of the sheet 103.

Figure 13:
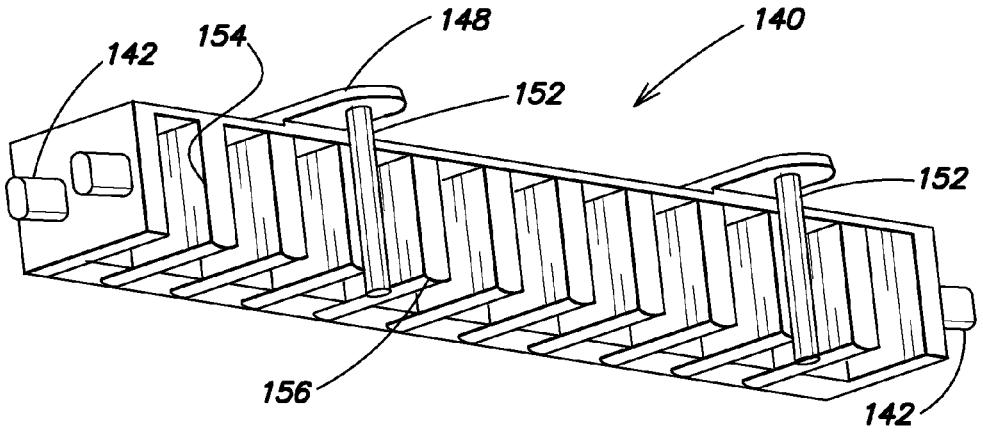
FIG. 13 is a rear perspective view of a binding member according to one embodiment.

When the sheet 103 is in the proper binding position, a user may activate a binding member 140 to bind the sheet to the discs 100. FIG. 13 illustrates the binding member 140 according to one embodiment. The binding member may include a plurality of binding fingers 154. The binding member 140 may travel linearly in the direction of arrow A in FIG. 14 to move the binding fingers 154 between the discs 100 loaded in the ring rack 118. The binding fingers 154 may include a bottom curved surface 156 to press the cutouts onto the periphery 107 of the discs 100. When a user activates the lever 109, the binding member 140 may displace the binding fingers 15*g* an appropriate distance between the discs 100 such that the curved surfaces 156 gently force the cutouts to open up and grab onto the discs. The curved surfaces 156 may prevent creasing and tearing of the sheet 103.

Figure 14:
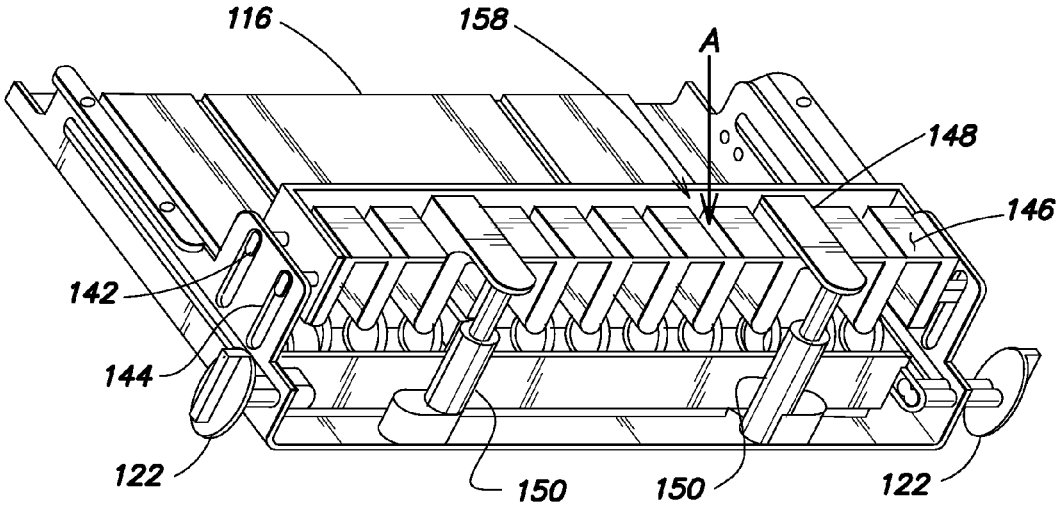
FIG. 14 is a rear perspective view of a binding portion of the binding machine according to one embodiment.

As shown in FIGS. 13 and 14, the binding member 140 may be connected to the binding chassis 113 by rods 152 that ride in rear channels 150. The binding member 140 also may be secured to the binding chassis 116 by side protrusions 124 that ride in side wall slots 144 of the binding chassis. The binding fingers 154 may be connected at an upper surface 146.

Figure 15:
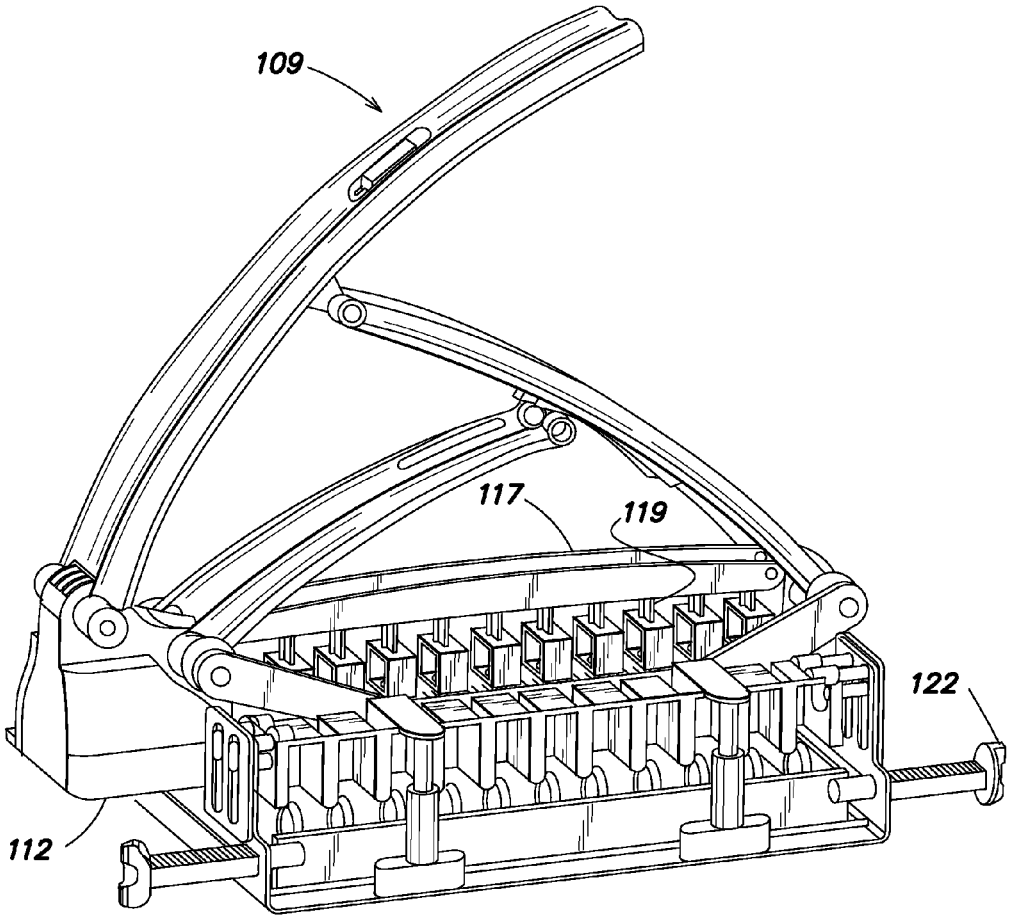
FIG. 15 is a rear perspective view of the binding machine in an unactivated state, according to one embodiment.
Figure 16:
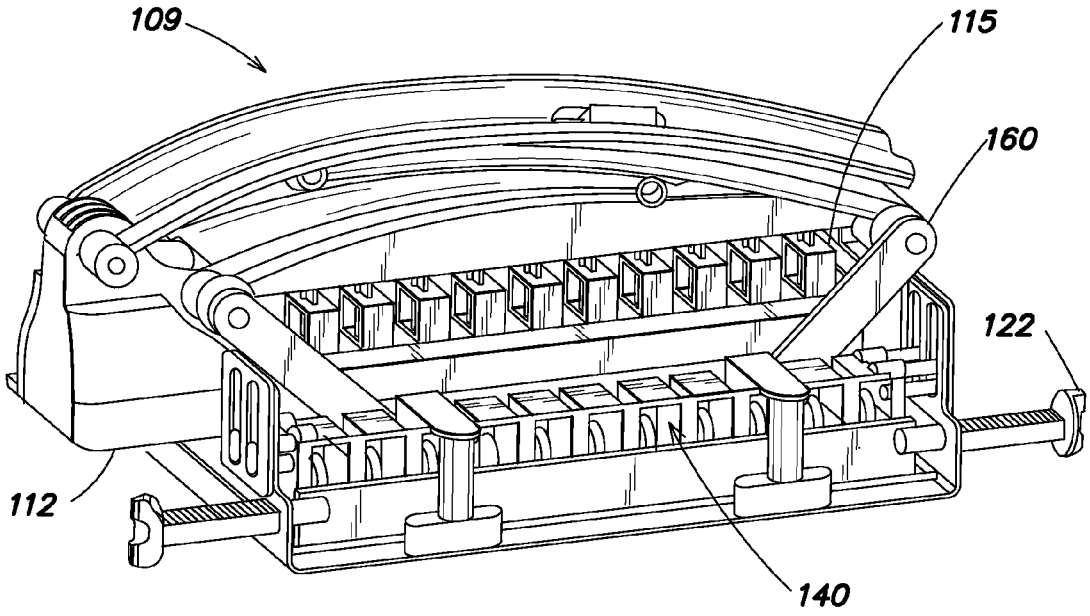
FIG. 16 is a rear perspective view of the binding machine in an activated state, according to one embodiment.

In one embodiment, shown in FIG. 10, the binding member may be actuated by the lever 109 that also actuates the punching portion. Flippers 160 may connect the lever 109 to the binding member 140. An end of the flipper may be pivotally connected to the lever 109 via a flipper connector 162 (shown in FIG. 17) at the base 112 and another end of the flipper 162 may be connected to or contact the binding member 140. For example, the flippers 160 may be fastened to the binding member 140 (e.g., rotatably connected) or may contact an upper surface of the binding member. According to one embodiment, the flippers slide within a recess 158 on an upper surface of the binding member 140. When the lever 109 is pressed downwardly, the flippers 160 may rotate and push down the binding member 140. FIG. 15 shows the lever in the inactivated state and FIG. 16 shows the lever in the activated state, in which the flippers are rotated and pressing down the binding member 140.

In one embodiment, the lever displaces both the punches 119 and the binding member 140 simultaneously. It is necessary to displace the punches 119 a sufficient distance to fully punch the cutouts 102 in the sheets 103. When there are no sheets in the binding area, the binding member 140 can displace fully without resistance, allowing the user to press completely down on the lever 109 to completely displace the punches 119 to achieve a full punch. However, when sheets 103 continue to be added in the binding portion 99 as a user builds a notebook presentation, the sheets may block the binding member 140 from displacing the full linear distance. If the blocking member displacement is inhibited, the lever 109 may not be compressed completely to achieve a full punch.

Figure 17:
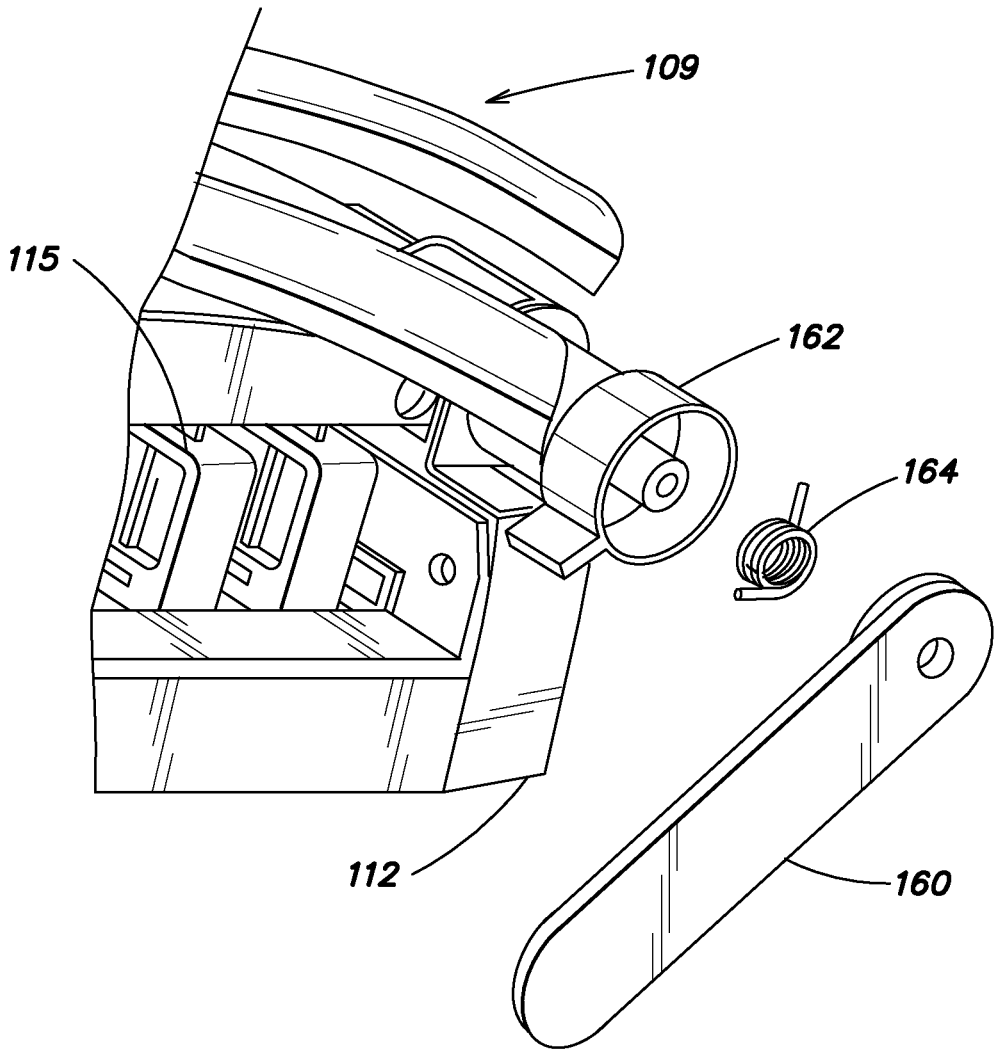
FIG. 17 is a perspective view of a flipper according to one embodiment.

According to one embodiment, to compensate for sheets in the binding portion 99, a torsion spring 164 may be included in flipper connector 162 or within the pivotal connection between the flippers 160 and the lever 109, as shown in FIG. 17. The torsion spring 164 may allow the user to continue to compress the lever 109 even when there is a stack of sheets in the binding portion 99. For example, when the binding member 140 may not fully displace due to a stack of sheets in the binding portion and the flippers 160 may be prevented from rotating any further, rather than jamming the lever 109, the torsion spring 164 may twist to allow the user to continue pressing down on the lever. The punches 119 may continue to displace the full linear distance to achieve a complete punch even when the binding members may be blocked by a stack of sheets in the binding portion. The torsion spring 164 also may prevent creasing and tearing due to excessive forces exerted by the user to punch the cutouts 102. Accordingly, a user may build a presentation by punching and binding with only one lever to activate both actions.

According to one embodiment, as listed in FIG. 18, a user may create a disc-bound presentation by using the following steps:

1. The binding machine 101 is open and ready to operate.
2. A user slides the disc rack carriage 120 forward to the loading position. The user may use the handles 122 to slide the disc rack carriage.
3. The user loads a plurality of discs 102 into the rick rack 118.
4. The user slides the ring rack carriage 120 rearwardly into the binding position.
5. The user inserts sheets 103 into the punching portion 111 of the binding machine 104.
6. The user presses the lever 109 to actuate the punching portion to punch cutouts 102 in the binding edge 105 of the sheets 103.
7. The user releases the lever 109.
8. The user removes the punches sheets from the punching portion.
9. The user inserts the punches sheets, binding edge first, into the binding portion 99 of the binding machine.
10. The user presses the lever 109 to activate the binding member 140 to bind the sheets 103 onto the discs 100.
11. The user releases the lever 109.
12. Steps 5 through 11 are repeated until the presentation is complete.
13. The user removes the completed presentation from the binding machine.

According to one embodiment, as listed in FIG. 19, the binding machine 104 is assembled using the following steps:

1. Metal housing is stamped and formed into punch frame (98).
2. Plastic components are injection molded.
3. Punch heads (115) are assembled onto punch frame (112).
4. Punch arms (110) are assembled onto punch frame (112).
5. Disk rack carriage (120) is assembled onto binding frame (113).
6. Disk rack (118) is assembled onto Disk rack carriage (120).
7. Binding member (140) is assembled onto Disk Rack (118).
8. Punch mechanism (111) is assembled onto binding mechanism (99).

9. Spring (162) and flipper arms (160) assembled onto punch mechanism (111) and aligned with binding member (140).

10. Outer plastic housing fitted over punch and binding mechanism.

Figure 20:
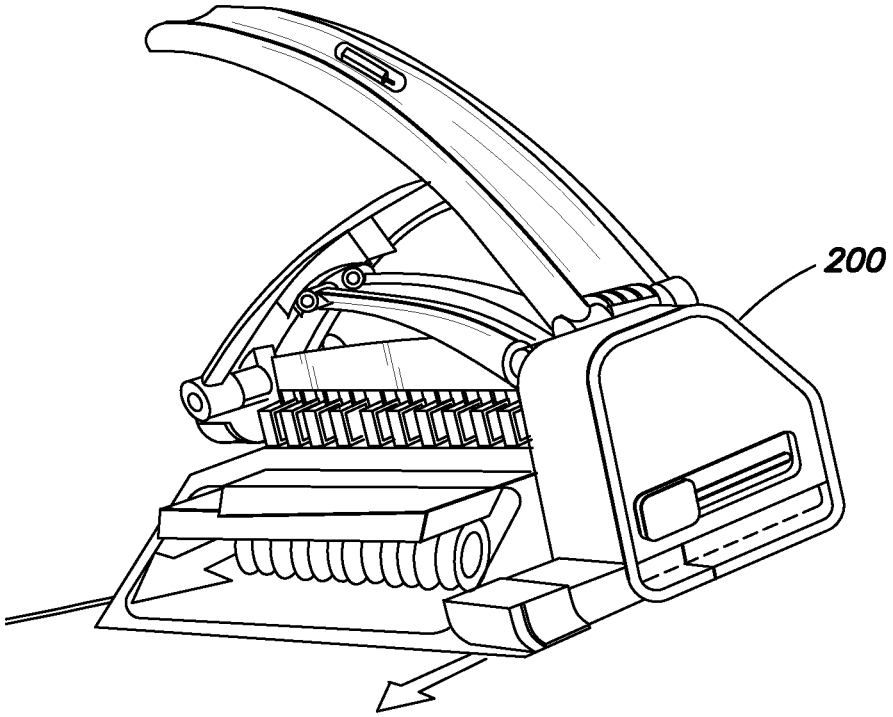
FIG. 20 shows an embodiment of the binding machine.

FIG. 20 shows an embodiment of the binding machine with a cover 200.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

The invention claimed is:

1. A hole punch, comprising:

a base;

a plurality of punching devices arranged along a longitudinal axis of the base and configured to punch cutouts along an edge of a sheet of paper, such that a cutout is formed at the edge of the sheet of paper, wherein at least a portion of the cutout has a width wider than a width of the cutout measured at the edge;

a lever to actuate the plurality of punching devices, the lever including:

a first arm having a first end pivotally connected to a first side of the base;

a second arm having a first end pivotally connected to a second side of the base and a second end slidably connected to an underside portion of the first arm; and a third arm having a first end pivotally connected to the second side of the base, wherein the first arm has a second end slidably connected to an underside portion of the third arm, and wherein the hole punch is fastened to a binding machine, the binding machine comprising a binding member configured to bind the sheet of paper to a plurality of discs, wherein the lever simultaneously activates the punching devices and the binding member.

2. The hole punch of claim 1, further comprising a flipper to connect the lever to the binding member.

3. The hole punch of claim 2, wherein the flipper comprises a torsion spring.

4. A punching and binding machine for assembling presentations, comprising:

a chassis;

a punching device configured to punch at least one cutout along an edge of a sheet, wherein at least a portion of the at least one cutout has a width wider than a width of the cutout measured at the edge;

a disc rack carriage for holding at least one disc having a raised periphery, the raised periphery adapted to be received in the at least one cutout;

a binding member configured and arranged to press a portion of the sheet surrounding the at least one cutout onto the raised periphery of the at least one disc;

a lever configured to actuate the punching devices and the binding member simultaneously; and a flipper to connect the lever to the binding member; and a torsion spring in the flipper.

5. The punching and binding machine of claim 4, wherein the disc rack carriage comprises at least one slot for holding the at least one disc.

6. The punching and binding machine of claim 5, wherein the at least one slot is made of a rubber material.

7. The punching and binding machine of claim 4, wherein the disc rack carriage comprises an angled front edge.

8. The punching and binding machine of claim 4, wherein the disc rack carriage comprises a paper stop.

9. A punching and binding machine for assembling presentations, comprising:

a chassis;

a punching device configured to punch at least one cutout along an edge of a sheet, wherein at least a portion of the at least one cutout has a width wider than a width of the cutout measured at the edge;

a disc rack carriage for holding at least one disc having a raised periphery, the raised periphery adapted to be received in the at least one cutout;

a binding member configured and arranged to press a portion of the sheet surrounding the at least one cutout onto the raised periphery of the at least one disc; and a lever configured to actuate the punching devices and the binding member simultaneously, wherein the lever comprises:

a first arm having a first end pivotally connected to a first side of the chassis;

a second arm having a first end pivotally connected to a second side of the chassis and a second end slidably connected to an underside portion of the first arm; and a third arm having a first end pivotally connected to the second side of the chassis, wherein the first arm has a second end slidably connected to an underside portion of the third arm.

10. The punching and binding machine of claim 4, wherein the chassis comprises tracks to slideably guide the disc rack carriage between a loading position and a binding position.

11. The punching and binding machine of claim 4, wherein the disc rack carriage comprises a handle.

12. The punching and binding machine of claim 4, wherein the binding member comprises a protrusion configured to move within a guiding slot of the chassis.

13. The punching and binding machine of claim 4, further comprising sheet alignment members to accommodate different sized sheets.

14. The punching and binding machine of claim 4, wherein the binding member comprises binding fingers configured to displace between two or more discs held in the disc rack carriage.

15. The punching and binding machine of claim 14, wherein the binding fingers comprise bottom curved surfaces.

16. The punching and binding machine of claim 4, wherein the binding member comprises a rod that rides within a channel of the chassis, wherein the rod and channel are arranged in a direction of a binding action.

17. The punching and binding machine of claim 4, wherein the flipper contacts and slides within an upper recess of the binding member to actuate the binding member when the lever is compressed.

* * * * *